United States Patent [19]

Irmscher

[11] 4,227,384

[45] Oct. 14, 1980

[54] KNITTING-MACHINE PATTERNING SYSTEM

[75] Inventor: Helmut Irmscher, Karl-Marx-Stadt, Fed. Rep. of Germany

[73] Assignee: VEB Wirkmaschinenbau Karl-Marx-Stadt, Karl-Marx-Stadt, Fed. Rep. of Germany

[21] Appl. No.: 893,325

[22] Filed: Mar. 31, 1978

[30] Foreign Application Priority Data

Apr. 4, 1977 [DE] Fed. Rep. of Germany ..... 198225

[51] Int. Cl.[2] ..... D04B 15/70; D04B 15/74

[52] U.S. Cl. ..... 66/75.1

[58] Field of Search ..... 66/75.1, 66/64, 36, 50 B, 50 A (U.S. only)

[56] References Cited

U.S. PATENT DOCUMENTS

| | | | |
|---|---|---|---|
| 2,821,073 | 1/1958 | Mehnery | 66/75.1 X |
| 3,075,372 | 1/1963 | Philip | 66/50 A |
| 3,224,227 | 12/1965 | Beckenstein | 66/50 A |
| 3,283,540 | 11/1966 | Levin | 66/36 |

FOREIGN PATENT DOCUMENTS

| | | | |
|---|---|---|---|
| 272307 | 6/1927 | United Kingdom | 66/50 A |

*Primary Examiner*—Wm. Carter Reynolds
*Attorney, Agent, or Firm*—Michael J. Striker

[57] ABSTRACT

A cam carriage, provided with a jack-filled pattern wheel followed by a knitting cam system, travels along a needle bed of a flat-bed knitting machine. Those pattern-wheel jacks which are selected for operation by a jacquard mechanism cause selected needles to be transversely shifted away from the knitting cam system. The pattern wheel has a first and a second circumferential succession of jacks, and two jacks per interneedle interval of the pattern-wheel circumference. The needle-controlling portions of the jacks of the first succession are located at different heights from those of the second succession. Some groups of needles have jack-engaged members located at the height of the needle-controlling portions of the first jacks. The other groups of needles have jack-engaged members located at the height of the needle-controlling portions of the second jacks. As the cam carriage performs a stroke, and the pattern wheel performs a first rotation, the needles which the pattern wheel passes are controlled by the first circumferential succession of jacks. As the stroke continues, and the pattern wheel performs a second rotation, the needles which the pattern wheel passes during the second rotation are controlled by the second circumferential succession of jacks. Thus, a base pattern can have a width corresponding to twice the pattern-wheel circumference. The correlation between needle groups and the two circumferential successions of jacks is selectable, for implementing complex patterning effects.

10 Claims, 9 Drawing Figures

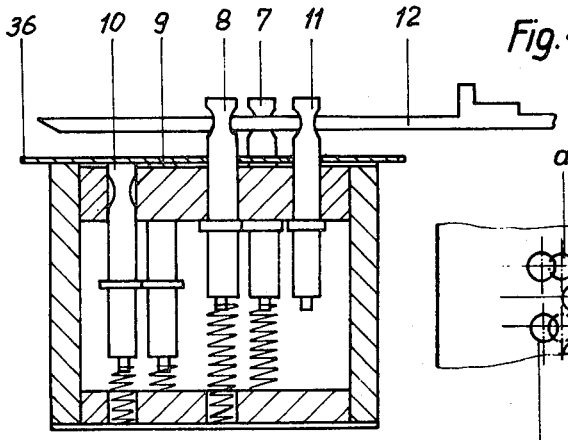
Fig. 4a
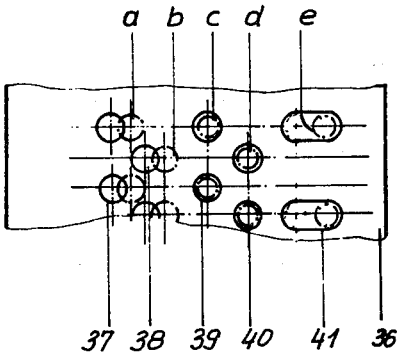
Fig. 4b
Fig. 5
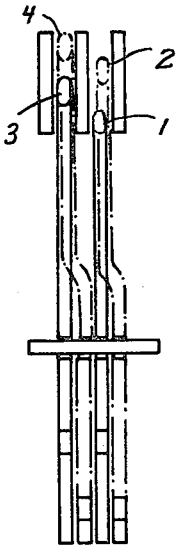
Fig. 6
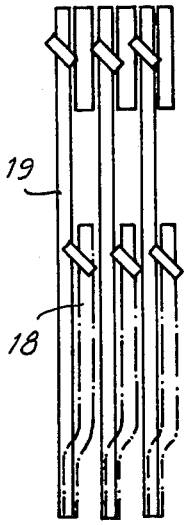

KNITTING-MACHINE PATTERNING SYSTEM

BACKGROUND OF THE INVENTION

The present invention relates to pattern-wheel control of flat-bed knitting-machine operation, and in particular to the use of a pattern wheel on a cam carriage for the specific purpose of shifting selected needles in a direction away from the knitting cam system of the carriage.

In terms of implementation, the invention is at least presently concerned with a type of knitting machine in which the shanks of the needles in the needle bed extend through guide passages in pattern bolts. The pattern bolts extend in a direction which is transverse to both the direction of needle elongation and the direction in which the cam carriage travels. Jacks on the pattern wheel are selected, by a jacquard mechanism. The selected jacks engage the pattern bolts of certain needles, and thereby move just these needles away from the knitting cam system of the cam carriage.

German Democratic Republic patent 15 733 discloses a patterning arrangement of the type just referred to. Before the operating stroke of the cam carriage, pattern information is transmitted to the pattern-wheel jacks from a jacquard card laid onto the face of one facet of an indexible jacquard prism. After being thusly programmed, the pattern-wheel jacks are arrested in their programmed positions. The circumferential succession of pattern-wheel jacks are circumferentially spaced one per interneedle interval of the pattern-wheel circumference. During a cam-carriage stroke, the bolt-engaging portions of the selected pattern-wheel jacks act upon the pattern bolts of the selected needles, pushing the selected pattern bolts and thereby the selected needles out of the operative range of the knitting cam system of the cam carriage.

In the type of machine in question, the base pattern is limited in its breadth to a value corresponding to the circumference of the pattern wheel. If the width of the base pattern is to be increased, this requires the use of larger-circumference pattern wheels, such larger wheels, however, again having jacks which are circumferentially distributed one per interneedle interval. Because of space problems with this type of machine, the circumference of the pattern wheel cannot be readily increased, and certainly cannot be increased without limit. Thus, the largest base pattern to be horizontally repeated will have a width corresponding to the number of one-per-interneedle-interval jacks in the pattern wheel. The knitting of a base pattern whose width corresponds, for example, to twice the pattern-wheel circumference is not possible.

Additionally, with this type of machine, it is not possible for a pattern to be knit at just selected parts of the needle bed, e.g., plain knitting at the left and right thirds of the fabric and patterned knitting at the middle third of the fabric.

In view of these important patterning limitations, German Federal Republic published patent application DT-OS 2,424,836 discloses the provision of retracting devices on the needle bed, the retracting devices comprising elastic plates. These elastic plates are so arranged on the needle bed that they can move selected groups of successive needles from the operative vicinity of the knitting cam system of the cam carriage. Specifically, each such retracting device, when operative, removes a group of successive needles corresponding in number to the pattern-wheel circumference. The cam carriage is provided with selector means which when activated causes selected retracting devices to leave their respective groups of needles within the operative range of the knitting cam system on the carriage.

Thus, as the cam carriage performs a stroke, and the pattern wheel rotates repeatedly, the circumferential succession of jacks on the pattern wheel control needle groups during only preselected pattern-wheel rotations, whereas during the remaining pattern-wheel rotations the groups of needles passed by the pattern wheel are simply moved, in groups, away from the knitting cam system of the cam and therefore do not knit when the cam system passes them by. With this technique, it certainly is possible to knit in dependence upon the pattern information programmed into the pattern-wheel jacks, at only selected portions of the length of the needle bed. However, this expedient inherently decreases machine productivity, due to the many stretches of operation during which no knitting is occurring.

SUMMARY OF THE INVENTION

It is a general object of the present invention to improve upon the types of flat-bed knitting-machine patterning arrangements just discussed, in such a manner that the increased patterning capabilities are not achieved at the expense of machine productivity. It is to be possible to knit, in accordance with the pattern information programmed into the jacks of the pattern wheel, during any selected one or ones of the pattern-wheel rotations performed during a cam-carriage stroke, or even during for example selected half-rotations of the pattern wheel. Additionally, it is to be possible to knit a base pattern whose width corresponds to a multiple of the pattern-wheel circumference.

Most broadly, this is achieved by providing the pattern wheel with more than one jack per interneedle interval of the pattern-wheel circumference, in the preferred embodiment two jacks per interneedle interval. This stands in contrast to comparable pattern wheels provided with only one jack per interneedle interval of the pattern-wheel circumference. As a result of this, twice as much pattern information can be stored on the pattern wheel, enough to produce a base pattern having a width corresponding to two pattern-wheel rotations.

To give the designer a readily visualizable and orderly manner of implementing complex pattern changeovers, it is not in general sufficient that the pattern wheel merely have twice as many jacks. Therefore, in the preferred embodiment of the invention, the pattern wheel is provided with a first and a second circumferential succession of jacks. The heights of the needle-controlling portions of the jacks of the second succession are different from the heights of the needle-controlling portions of the jacks of the first succession of jacks. Within each of the two successions of jacks, the interjack spacing corresponds to the interneedle interval of the pattern-wheel circumference. Accordingly, the second circumferential succession of jacks forms, in effect, a second or "ghost" pattern wheel, from which control information can be drawn during selected pattern-wheel rotations, half-rotations, or the like. Alternatively, one half of a double-width pattern (or, more precisely, that part of one half of the pattern pertaining to one course) can be stored on the first circumferential succession of jacks, with the other half of the double-width pattern stored on the second circumferential succession of jacks.

The needles which are to be controlled by the first circumferential succession of jacks are provided with pattern bolts located at the heights of the needle-controlling portions of those jacks; the needles which are to be controlled by the second circumferential succession of jacks are provided with pattern bolts located at the heights of the needle-controlling portions of the jacks of the second succession. For example, the pattern wheel may have a first circumferential succession of 36 jacks, and a second circumferential succession of 36 jacks, with two jacks per interneedle interval of the pattern-wheel circumference. The first 36 needles of the bed are provided with first-height pattern bolts, the next 36 needles with second-height pattern bolts, the third group of 36 needles with first-height pattern bolts, and so forth. Then, during the first pattern-wheel rotation the first succession of jacks control; during the second pattern-wheel rotation the second succession of jacks control; during the third pattern-wheel rotation the first succession of jacks again control; and so forth. Thus, if the first succession of jacks store the first half of a double-width pattern, and the second succession of jacks the second half of the pattern, the width of the base pattern will correspond to two pattern-wheel rotations.

Alternatively, for example, the first 36 needles could be provided with first-height pattern bolts, and all subsequent needles with second-height pattern bolts. Then, during the first pattern-wheel rotation the first succession of jacks would control, whereas during all subsequent pattern-wheel rotations the second succession of jacks would control. Accordingly, the pattern programmed onto the pattern wheel (in particular, the first succession of jacks thereon) is produced at only a part of the fabric; to this extent, the result is equivalent to that described above with respect to German Federal Republic published patent application DT-OS 2,424,836. However, in the present case, with the example just given, during all pattern-wheel rotations subsequent to the first, the needles passed by the pattern wheel are not forced into no-knit positions, but instead can knit in accordance with the pattern information programmed onto the second circumferential succession of jacks, and thereby remain productive.

Instead of the needles being subdivided into groups of 36 each, one group per pattern-wheel rotation, the needles could, for example, be subdivided into groups of 18 each, i.e., one group per half-rotation, to be able to implement more complex pattern changeovers.

To facilitate changeovers in the correlation between needle groups and pattern-wheel rotations, it is contemplated that the bed of pattern bolts be provided with a series of shiftable members, e.g., one per pattern-wheel rotation. Each shiftable member is shiftable between a setting correlating the associated needle group with the first circumferential succession of jacks, and a second setting correlating the associated needle group with the second circumferential succession of jacks. Alternatively, there could be one such shiftable member per pattern-wheel half-rotation, to correlate smaller needle groups with different ones of the four distinguishable half-rotations of the pattern wheel, and so forth.

The present invention contemplates these broad concepts. Additionally, the present invention is concerned with implementing these concepts without extensive redesign of existing machines of the type in question. To this end, the invention contemplates configuring and arranging the two successions of pattern-wheel jacks, and also the jacquard selectors which select the jacks, in such a way that minimal modification of existing machines, and of the jacquard patterning mechanisms of such machines, be needed. These features are discussed in the explanation of preferred embodiments of the invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS:

FIG. 4*a* is a sectional view of a modified pattern-bolt set-up and FIG. 4*b* is a view of the cover plate of FIG. 4*a;*

FIG. 5 depicts the manner in which the jacks in the pattern wheel of FIG. 1 are arranged;

FIG. 6 depicts the manner in which the jacquard selectors are offset, in order to be able to properly select pattern-wheel jacks.

DESCRIPTION OF THE PREFERRED EMBODIMENTS

Figure 1:
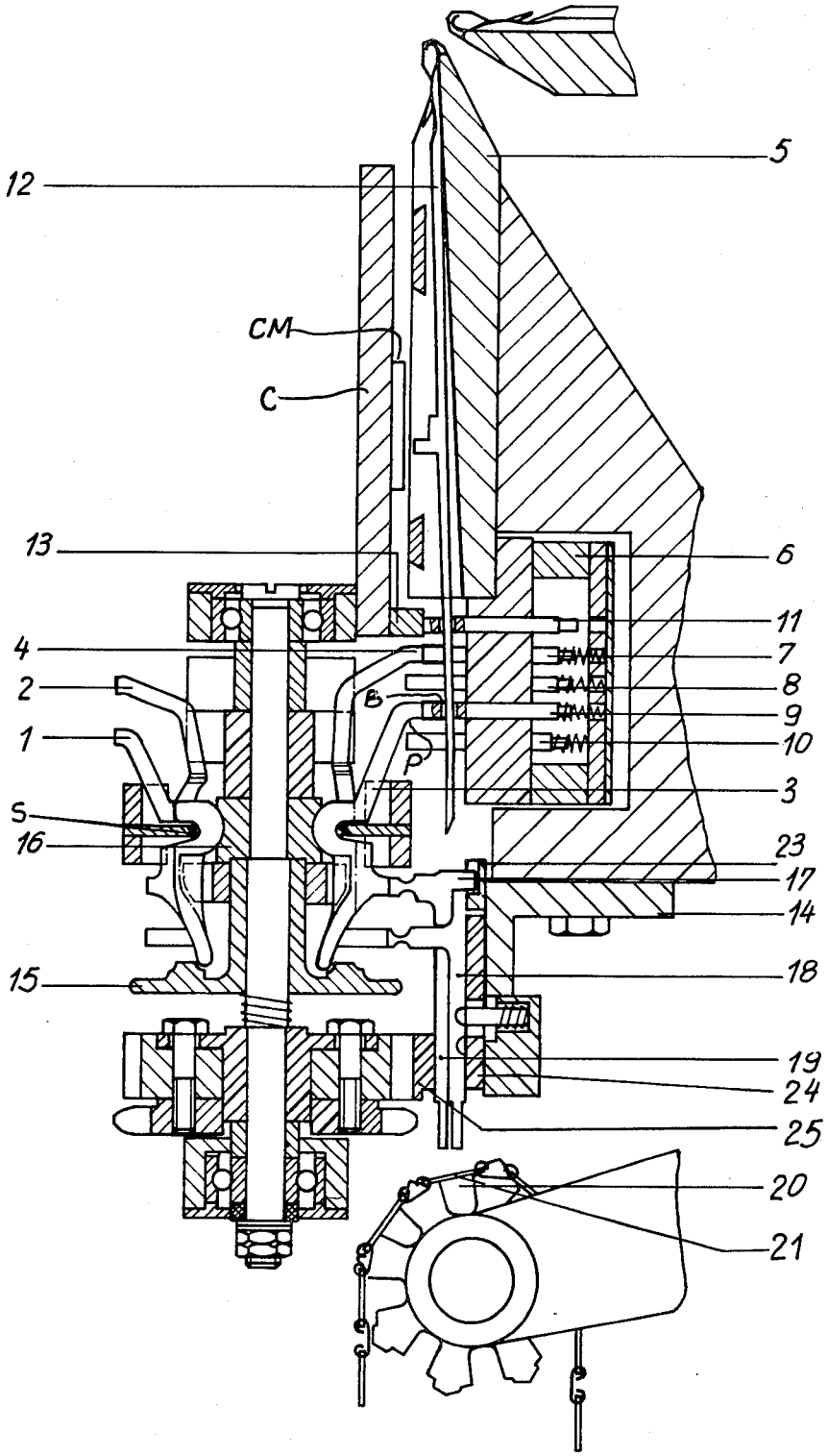
FIG. 1 is a transverse section through the vertical needle bed of a flat-bed knitting machine, showing also in section the pattern wheel on a cam carriage of the machine and the mounting of pattern bolts.

FIG. 1 is a sectional view through the vertical bed of a flat-bed knitting machine, through the pattern wheel of a cam carriage of the machine, and through the pattern bolt system of the machine.

Figure 3:
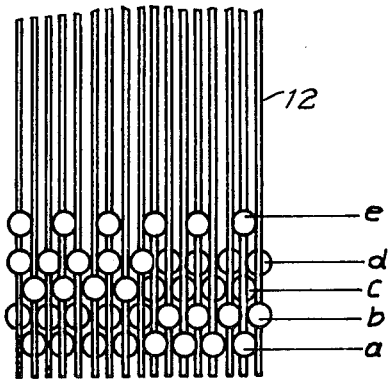
FIG. 3 is a front view looking at the needles in part of the needle bed of FIG. 1, showing the manner in which the needles are correlated with respective ones of the pattern bolts.

A bolt bed 6 mounts four horizontal rows of pattern bolts 7, 8, 9, 10 and above the latter one horizontal row of starting edge trim bolts 11. The pattern bolts 7–10 are mounted spring-biased towards the left, and depressible into retracted position towards the right. The pattern bolts 7–10 are provided at their left ends with vertical guide bores B, through which the shanks of various knitting needles 12 in a needle bed 5 are inserted. Each single knitting needle 12 has its shank inserted through the vertical guide bore B of just one of the pattern bolts 7–10, whereas certain ones of the needles 12 are additionally inserted through the vertical guide bores of starting-edge-trim bolts 11. FIG. 3 depicts the four rows a to d in which the pattern bolts 7–10 are arranged, and the arrangement of a fifth row e for the starting-edge-trim bolts 11. This is explained in greater detail below.

The pattern wheel 16 on the cam carriage C carries a circumferential succession of tiltable jacks 1–4. Each jack 1–4 is mounted tiltable about its center of gravity S. Each jack 1, 2, 3 or 4 has an operative position, in which its upper part is tilted radially outward, and an inoperative position, in which its upper part is tilted radially inward. The jacks 1, 2, 3 or 4 are selected for assumption of operative or inoperative position at their lower ends, by means of jacquard selectors 18, 19 controlled by a jacquard mechanism described below. During the programming of the pattern-wheel jacks, an arresting plate 15 on the pattern wheel 16 is axially displaced to its released position, so that the jacks 1–4 can be programmed; after the programming is completed, the arresting plate 15 is raised, to lock the jacks 1–4 in the positions selected for subsequent knitting. The arresting plate 15 can be lowered to its released position and raised to its locking position by conventional means (see, e.g., U.S. Pat. No. 2,821,073, column 2, lines 31–39), using a stationary lowering cam passed by the plate 15 prior to reaching the jacquard mechanism to effect the lowering of plate 15, and to effect the raising of plate 15 using a stationary raising cam which plate 15 passes after the jacks 1–4 have been programmed and before cam carriage C perorms its next stroke. The upper surface of arresting plate 15 has plural steps, so that when plate 15 returns to locking position the bottom end portions of all jacks 1–4, whether in operative or inoperative position, will be firmly supported in place.

During knitting, the cam carriage provided with the pattern wheel performs a stroke along the needle bed 5, and as this occurs, the pattern wheel 16 rotates synchronously, with the upper parts of circumferentially successive jacks 1–4 engaging various ones of the pattern bolts 7–10, displacing the latter rightwards into retracted position. The bolt-engaging portions of the jacks 1, 2, 3 and 4 are arranged at different respective heights, in correspondence to the four rows a, b, c, d in which the pattern bolts 7, 8, 9, 10 are disposed. During one stroke of the cam carriage, and concomitant rotation of the pattern wheel along the rows of pattern bolts 7–10, each pattern bolt to be rightwardly retracted is retracted by means of only a single one of the jacks on the pattern wheel.

As will become clearer, the four sets of jacks 1–4 form, in effect, a first circumferential series of jacks 1 and 3, and a second or "ghost" series of jacks 2 and 4. For the purpose of explanation, the presence of the second or ghost jacks 2 and 4 will initially be ignored. Considering only the jacks 1 and 3, the bolt-engaging portions of the jacks 1 are capable of acting upon and retracting the pattern bolts 10 of the bolt row a (see FIG. 3). The bolt-engaging portions P of the jacks 3 are capable of acting upon and retracting the pattern bolts 9 of the bolt row b (see FIG. 3). Proceeding circumferentially around pattern wheel 16, and considering only the jacks 1 and 3, these alternate with each other. FIG. 5 depicts the arrangement of pattern-wheel jacks on the pattern wheel. A pattern-wheel jack 3 is immediately followed by a pattern-wheel jack 1, which in turn will be immediately followed by a pattern-wheel jack 3; i.e., the jacks 1 and 3 alternate, going circumferentially. Furthermore, the circumferential spacing between the activating portions of adjoining jacks 1 and 3 is equal to the interneedle spacing on the needle bed 5.

Thus, if the second or ghost jacks 2 and 4 are ignored, then during cam-carriage travel, a pattern wheel jack 1 (if operative) depresses the a-row pattern bolt of one needle 12; the next-following jack, which is a jack 3, (if operative) depresses the b-row pattern bolt of the very next needle 12; then the next-following jack, which is again a jack 1, (if operative) depresses the a-row pattern bolt of the third needle 12; and so forth.

In the illustrated embodiment, the bolt engaging portions of the first circumferential series of jacks 1 and 3 are split into two levels, and the corresponding pattern bolts 9 and 10 are split into two rows a and b, as clearly shown in FIG. 3. This may be desirable to create certain patterning possibilities, and/or may be necessary to avoid excessive spatial cramping of jacks and pattern bolts. In principle, however, the first circumferential series of pattern-wheel jacks 1 and 3 could have their bolt-engaging portions all located at a common height; and the pattern bolts 9 and 10 of successive needles 12 could all be located in a single horizontal bolt row, instead of alternating back and forth between the bolt rows a and b.

The split-up arrangement of jacks 1 and 3 and pattern bolts 9 and 10 into two levels and two bolt rows will be understood from a consideration of FIG. 3, which shows seventeen successive knitting needles 12, the spatial arrangement of horizontal bolt guide bores in the bolt bed 6, and the manner in which pattern bolts are accommodated within some of the bolt guide bores. As can be seen, each third needle 12 in FIG. 3 has its shank threaded through the vertical guide passage of a patent bolt in the bolt row e. The starting-edge-trim bolts 11 in bolt row e are not controlled by the pattern wheel 16, but instead by a press bar 13 (FIG. 1) for producing a special trim at the very start of knitting.

Proceeding left-to-right in FIG. 3, the shank of the first (leftmost) needle 12 passes through the guide bore of a bolt in row d (and also through the guide bore of a patent bolt in row e, but this is to be ignored, in so far as control by pattern wheel 16 is concerned). Lined up with the shank of this first (leftmost) needle, there is also provided, in the bolt bed 6, a horizontal bolt guide bore for a bolt in bolt row b. However, as shown in FIG. 3, for this first (leftmost) needle, no pattern bolt is actually present in bolt row b. Thus, this first (leftmost) needle 12 has its shank guided through only a single pattern bolt, namely a d-row pattern bolt. The second (from the left) needle 12 in FIG. 3 has its shank inserted through a pattern bolt in bolt row c. The shank of this second (from the left) needle in FIG. 3 is also lined up with a bolt guide bore located in bolt row a, but this second needle is not actually provided with a pattern bolt in bolt row a.

The third (from the left) needle 12 in FIG. 3 has its shank again inserted through a pattern bolt in bolt row d. The fourth needle in FIG. 3 has its shank again inserted through a pattern bolt in bolt row c, and so forth.

Thus, in FIG. 3, ignoring the starting-edge-trim bolts in row e, the first nine needle shanks (counting from the left) are alternately inserted through a pattern bolt in row d, then row c, then row d again, then row c again, and so forth, the ninth needle having its shank inserted through a d-row pattern bolt. Although these first nine needles are also lined up with bolt guide bores which alternate between rows a and b, these needles are not actually provided with pattern bolts in rows a and b. Thus, these first nine needles cannot be influenced by the pattern-wheel jacks 1 and 3, i.e., because they have no a-row or b-row pattern bolts.

In FIG. 3, the tenth through seventeenth needles (counting from the left) are successively threaded through pattern bolts which skip back and forth between the a and b bolt rows. The shank of the tenth needle is threaded through an a-row pattern bolt, the shank of the eleventh needle through a b-row pattern bolt, the shank of the twelfth needle through an a-row pattern bolt again, the shank of the thirteen needle through a b-row pattern bolt again, and so forth. These rightmost eight needles are also lined up with pattern-bolt guide bores which alternate between the c and d rows, but these bolt guide bores do not accommodate any c-row or d-row pattern bolts. Clearly, because these rightmost eight needles are provided with only a-row and b-row pattern bolts, these needles can be influenced only by the first circumferential succession of pattern-wheel jacks 1 and 3.

During cam-carriage travel, as the pattern wheel 16 rolls along the rows of pattern bolts 7–10, the jacks 1 and 3 of the first jack series have no influence upon the first (leftmost) nine needles shown in FIG. 3. However, when the pattern wheel reaches the rightmost eight needles, the jacks 1 and 3 (if in operative position) begin to control these needles. Assuming, for explanatory purposes only, that all of these rightmost eight needles are to be transversely displaced into non-knitting position, it will be clear that successive ones of these eight needles are thusly displaced by successive respective ones of the alternating jacks 1 and 3. Thus, the first of these needles (i.e., the tenth needle from the left) has its a-row pattern bolt depressed by an operative jack 1; the next of these needles (the eleventh) has its b-row pattern bolt depressed by an operative jack 3; the third of these needles (the twelfth in FIG. 3) has its a-row pattern bolt depressed by an operative jack 1; the fourth of these needles has its b-row pattern bolt depressed by an operative jack 3; and so forth. The second-rotation or ghost jacks 2 and 4, even if in operative setting, cannot effect displacement of these needles, because jacks 2 and 4 act only on c-row and d-row pattern bolts, whereas these rightmost eight needles are not provided with c-row or d-row pattern bolts.

As already stated, and as shown in FIG. 5, the jacks 1 and 3 alternate around the circumference of the pattern wheel, to form a first succession of jacks, and the circumferential spacing between the bolt-engaging portion of a jack 3 and that of its neighboring, immediately following jack 1 is equal to the interneedle spacing on needle bed 5. As shown in FIG. 5, the second or ghost jacks 2 and 4 form a second succession of jacks, the jacks 2 and 4 likewise alternating around the circumference of the pattern wheel. Again, the spacing between the bolt-engaging portion of a jack 4 and that of its neighboring, immediately following jack 2 is equal to the interneedle spacing on needle bed 5. As can be seen from FIGS. 1 and 5 in conjunction, each jack 4 forms a second or ghost jack relative to a jack 3; and each jack 2 forms a second or ghost jack relative to a jack 1. The bolt-engaging portion of each jack 4 is located directly above that of the corresponding jack 3; likewise, the bolt-engaging portion of each jack 2 is located directly above that of the corresponding jack 1. However, the lower portions of the corresponding jacks 3 and 4, containing their radially outwardly projecting butts which are selectable by the jacquard selectors 18, 19, are located side by side, as shown in FIG. 5, with the butts per se located at two different levels. The same applies to the corresponding jacks 1 and 2. To this end, the second or ghost jacks 2 and 4 are bent-over elements, their upper parts, containing their bolt-engaging portions, being transversely offset relative to their lower parts, containing their butts. Alternatively, in order to create the requisite transverse offset for the ghost jacks 2 and 4, these can be of two-piece construction, e.g., be comprised of two flat parts located side-by-side, i.e., as an alternative to employing bent one-piece elements.

As indicated above, the programming of the pattern-wheel jacks 1–4, previous to the performance of a cam-carriage stroke, is performed by the jacquard selectors 18, 19 of a jacquard mechanism 14. The number of jacquard selectors 18, 19 in the jacquard mechanism 14 is equal to the total number of jacks 1–4 on the pattern wheel 16. Thus, let it be assumed that pattern wheel 16 has eighteen jacks 1, eighteen jacks 2, eighteen jacks 3 and eighteen jacks 4, for a total of seventy-two jacks in all. Then, the number of jacquard selectors 18, 19 in the jacquard mechanism will likewise be seventy-two, comprised of thirty-six jacquard selectors 18 for the jacks 2 and 4 and thirty-six jacquard selectors 19 for the jacks 1 and 3. The total length of the set of seventy-two jacquard selectors 18, 19 will be equal to thirty-six times the interneedle spacing on needle bed 5; i.e., proceeding along the cam-carriage travel direction, there are two jacquard selectors (one selector 18 and one selector 19) per interneedle interval. As will be seen from FIGS. 1 and 6 in conjunction, the jacquard selectors 18 and 19 are arranged in pairs, i.e., to form a series of thirty-six selector-pairs. The two jacquard selectors 18, 19 of each such pair are so arranged that their upper parts, and in particular their radially inward projections which activate the butts on jacks 1–4, be located one above the other; in contrast, their lower portions, which engage jacquard cards, are located side-by-side, both being located in the drawing plane in FIG. 1, and being located one directly behind the other in the drawing plane in FIG. 6. To this end, the jacquard selectors 19 are essentially straight members, whereas the jacquard selectors 18 are transversely offset, as shown in FIG. 6. The offset jacquard selectors 18, like the transversely offset jacks 2 and 4, can be bent elements or two-piece elements, to introduce the transverse offset. The jacquard selectors 19 are provided with noses 17, which project over the jacquard selectors 18. The jacquard selectors 18 and 19 are mounted in three stationary mounting plates 23, 24 and 25.

Figure 2:
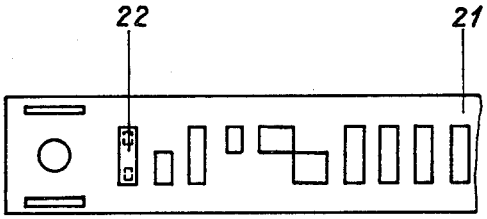
FIG. 2 depicts part of a long jacquard card which is perforated in accordance with one embodiment of the invention.

When programming of a pattern wheel is to be performed, the arresting plate 15 of the pattern wheel 16 drops. The jacquard mechanism includes an indexed jacquard prism 20, the successive facets of which each carry a jacquard card 21. For programming of a pattern wheel, the jacquard prism is raised so that its jacquard card 21 engages the bottom ends of the set of thirty-six selector-pairs 18, 19. As shown in FIG. 2, each jacquard card 21 contains a series of slits 22, the series of slits extending in the direction of cam-carriage travel, i.e., in the direction in which the series of thirty-six selector-pairs 18, 19 extends. As shown in FIG. 2, the two bottom ends of each selector-pair 18, 19 can enter into a single programming slit 22. In particular, each slit 22, or more precisely the area which it occupies if it is present, is subdivided into two regions, one for the jacquard selector 18 of the selector-pair 18, 19 and the other for the selector 19. Accordingly, each slit 22, or the area which it occupies if it is present, contains two pattern data, one for a selector 18 and the other for a selector 19, making it possible for each selector-pair 18, 19 to assume four different combinations of settings. Depending upon the combinations of slits 22 present on the jacquard card 21, various ones of the thirty-six selectors 18 and the thirty-six selectors 19 assume operative height (in which they can engage the butts of jacks 1–4)

or else inoperative height (in wich they cannot engage the butts of jacks 1–4). After the jacquard selectors 18, 19 have been thusly set, the pattern wheel 16, with its arresting plate 15 in lowered released position, rolls along the set of selectors 18, 19,and the pattern-wheel jacks 1–4 become programmed, whereafter the arresting plate 15 returns to its locked position, locking jacks 1–4 in the positions (operative or inoperative) just selected for them.

Figure 1A:
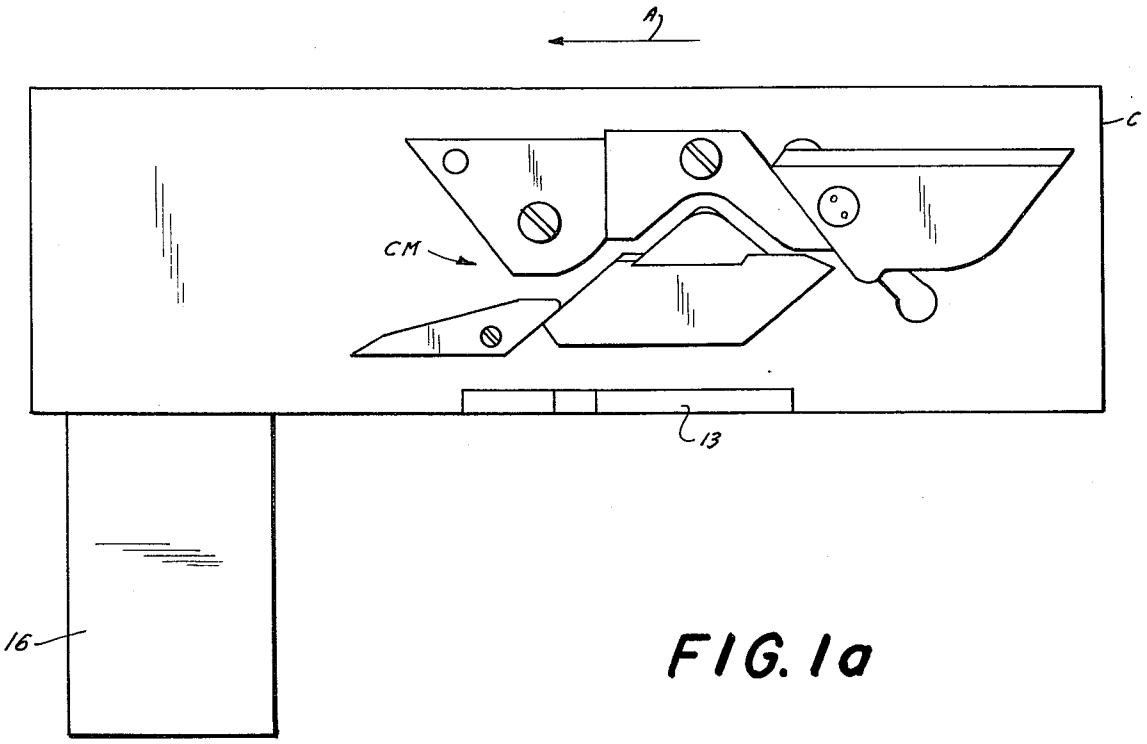
FIG. 1*a* is a view of the cam carriage shown in FIG. 1, with the pattern wheel of FIG. 1 here shown schematically.

The embodiment just described can be utilized in various ways. It will be clear that the pattern wheel 16, with its eighteen jacks 1 and eighteen jacks 3, and with its eighteen jacks 2 and eighteen jacks 4, amounts, in effect, to a first thirty-six-jack pattern wheel (having jacks 1 and 3) plus a second or ghost thirty-six-jack pattern wheel (having jacks 2 and 4). It may, for example, be desired to knit a pattern whose width corresponds to twice the circumference of the pattern wheel. In that event, the first half of the pattern can be programmed on the pattern wheel using only the jacks 1 and 3, and the second half using only the jacks 2 and 4. Likewise, the first thirty-six needles of the needle bed 5 will be provided with pattern bolts alternating back and forth between the a and b bolt rows. The next thirty-six needles of the needle bed 5 will be provided with pattern bolts alternating back and forth between the c and d bolt rows. The third group of thirty-six needles will again be provided with pattern bolts alternating back and forth between the a and b bolt rows. The forth group of thirty-six needles will be provided with pattern bolts again alternating between the c and d bolt rows; and so forth. Thus, as the cam carriage performs a stroke, and the pattern wheel 6 rotates along the bolt rows a-d, during the first pattern-wheel rotation the jacks 1 and 3 will act upon the a-row and b-row pattern bolts of the first thirty-six needles, causing these to move in accordance with the first half of the pattern. During the second pattern-wheel rotation, the jacks 2 and 4 will act upon the c-row and d-row pattern bolts of the second thirty-six needles, causing these to move in accordance with the second half of the pattern. Thus, the first seventy-two needles in the bed move in accordance with the double-width pattern. Likewise, the second seventy-two needles in the bed move in accordance with the double-width pattern. In particular, those needles whose pattern bolts are depressed rightwards in FIG. 1 do not knit, because the butts of these needles are displaced rightwards out of the vicinity of the knitting of the cam means CM cams on the cam carriage C, the knitting cams of the cam means CM following (being located upstream) of the pattern wheel 16 on the cam carriage C, as shown in FIG. 1*a*, arrow A indicating the direction of carriage travel. In contrast, those needles whose pattern bolts are not thusly depressed are engaged by the knitting cams, and therefore form loops. Of course, instead of these two positions (i.e., knit and welt) other positions (e.g., knit and tuck) could thusly be implemented, depending upon what cams the cam system on the carriage contains.

Instead of knitting a pattern whose width corresponds to twice the pattern-wheel circumference, it may be desired that, across almost the whole width of the fabric, a single pattern be repeatedly knitted, but with a second pattern being knitted only at a predetermined location. For example, it may be desired that a first pattern be knitted, with three horizontal repeats, at the middle of the fabric, with all the remainder of the fabric, to the left and to the right of the middle, being repeatedly knit with a second pattern. In such a case, the groups of thirty-six needles each at the middle portion in question will be provided with a-row and b-row pattern bolts and therefore be controlled in dependence upon the first pattern, by means of jacks 1 and 3; the remaining groups of thirty-six needles each, located to the left and right of the middle section, will be provided with c-row and d-row pattern bolts and therefore be controlled in dependence upon the second pattern, by means of jacks 2 and 4. Persons skilled in the art will understand that other such possibilities are likewise contemplated. Indeed, as an extreme of the possibility just mentioned, it may be desired that the pattern wheel, during its multiple rotations within one cam-carriage stroke, control needles by means of jacks 1 and 3 during only a single rotation, and control needles by means of jacks 2 and 4 during all others of its rotations. In that event, only one group of thirty-six needles would be provided with a-row and b-row pattern bolts, whereas all remaining needles would be provided with c-row and d-row pattern bolts.

From the foregoing examples, it will be appreciated that the setting-up of the pattern-bolt rows a to d involves a certain amount of inconvenience, i.e., if one has to periodically insert pattern bolts into different bolt rows, and remove them from others, for different patterning possibilities. Accordingly, the present invention contemplates a modification which greatly simplifies the work involved in such conversions. In accordance with this concept, all horizontal pattern-bolt bores shown in FIG. 3 contain pattern bolts. This is shown in FIG. 4*a*. As explained above with respect to FIG. 3, each needle shank is lined up with two pattern-bolt bores (one in row a or b, and another in row c or d) and possibly also is lined up with a patent bolt. In FIG. 4*a*, the pattern-bolt system is provided with a series of cover plates 36, mounted for shifting movement between first and second positions. As shown in FIG. 4*b*, each cover plate has a series of apertures 37 for a-row bolts, apertures 38 for b-row bolts, apertures 39 for c-row bolts, apertures 40 for d-row bolts, and elongated apertures 41 for e-row starting-edge-trim bolts. In the setting of shiftable cover plate 36 shown in FIG. 4*b*, the apertures 39 and 40 unblock the c-row and d-row bolts, and as shown in FIG. 4*a* the pattern bolts 7 and 8 can be engaged by jacks 2 and 4, whereas the pattern bolts 9 and 10 are hidden behind the cover plate 36 and completely inaccessible. In the other position of shiftable cover plate 36, the apertures 37 and 38 unblock the a-row and b-row pattern bolts, whereas the c-row and d-row bolts are kept hidden behind the cover plate and completely inaccessible. In both positions of the cover plate 36, the starting-edge-trim bolts of the e-row are unblocked and accessible to the press bar 13, because of the elongated shape of e-row apertures 41.

The embodiment of FIGS. 4*a* and 4*b* makes it unnecessary for the operator to fill and remove pattern bolts from the rows of bolt guide bores. Instead, the series of cover plates 36 are individually shifted from one of their positions to the other. For example, each individual cover plate 36 may extend along the bolt system for a length corresponding to thirty-six times the interneedle spacing on bed 5, i.e., to correlate certain rotations of the pattern wheel with jacks 1 and 3 and other rotations with jacks 2 and 4.

On the other hand, the operator, when he wises to thusly change the setting of a shiftable cover plate 36, must first lift the needles 12 associated therewith up, to unthread them from their present pattern bolts. Then he must depress the present pattern bolts to retracted positions back of the cover plate 36, for example using a pronged plate the prongs of which register with the pattern bolts to be pushed in. The operator thereafter actually shifts the cover plate, to lock in the thusly depressed pattern bolts, whereas the other pattern bolts then pop out by themselves. Finally, the operator lowers the needles associated with this cover plate, to thread them through their new pattern bolts. Again, each individual cover plate will have a length, measured in the cam-carriage travel direction, usually corresponding to the pattern-wheel circumference and therefore to one pattern-wheel rotation. However, for certain patterning effects, the cover plates could have, for example, half that length, in order to be able to change over from control by jacks 1 and 3, to control by jacks 2 and 4, in the middle of a pattern-wheel rotation.

Figure 7:
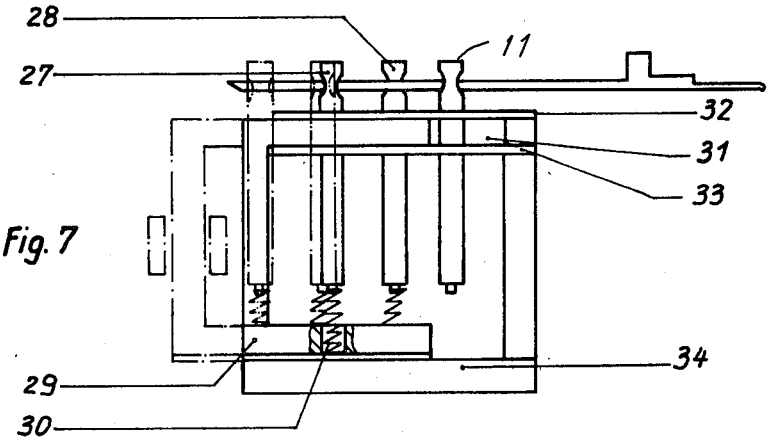
FIG. 7 depicts a still further pattern-bolt set-up.

A further bolt-row system is shown in FIG. 7. This embodiment has the advantage that the changeover in question requires no unthreading and retreading of needles, and requires no inconvenient pushing in or "hiding" of non-selected pattern bolts.

In the embodiment of FIG. 7, only two rows of pattern bolts 27 and 28 are employed. Each group of, for example, thirty-six pattern bolts is mounted in a respective shiftable U-shaped carrier 29 mounted on a housing 31. The housing 31 is provided with three guide plates 32, 33, 34, which serve to guide the shiftable U-shaped carrier. The starting-edge-trim bolts 11 are mounted in stationary guide bores of the housing 31 and do not shift. In contrast, the two rows of bolts 27 and 28 shift, when carrier 29 is shifted. In the illustrated (solid-line) setting of shiftable carrier 29, the row of bolts 28 assumes a position corresponding to the d-row in FIG. 3, whereas the row of bolts 27 assumes a position corresponding to the c-row in FIG. 3. In the other shifted position of carrier 29, the row of bolts 28 assumes a position corresponding to the b-row in FIG. 3, whereas the row of bolts 27 assumes a position corresponding to the a-row in FIG. 3. Thus, in one position of carrier 29, the pattern bolts 27 and 28 are controlled by jacks 1 and 3, whereas in the other position of carrier 29 the pattern bolts 27 and 28 are controlled by jacks 2 and 4. The length, in the cam-carriage travel direction, of each shifter 29 will usually correspond to the pattern-wheel circumference, e.g., be equal to thirty-six times the interneedle spacing. However, the subdivision into needle groups, by means of the series of individual shifters 29, could be made greater, for example by having each shifter correspond to only one half the pattern-wheel circumference. The shifters 29 are manually set, and then arrested in the selected setting. The operator need do nothing else. Additionally, the shiftable carriers 29 can be arrested in intermediate position, to prevent the pattern bolts 27, 28 from being engaged by any pattern-wheel jacks whatsoever, and thereby override pattern-wheel control during selected pattern-wheel rotations, or the like.

In the embodiments described above, the pattern wheel is provided with two jacks 1 and 2 or 3 and 4 per interneedle interval thereby making it possible, for example, to produce patterns whose width corresponds to twice the pattern-wheel circumference of a comparable prior-art pattern wheel. However, it will be understood that, for example, the pattern wheel could in principle be provided with three jacks per interneedle interval, to make possible repeated knitting of a triple-width pattern.

Likewise, in the embodiments illustrated, the first series of jacks 1 and 3 operate during one pattern-wheel rotation, and then the second series of jacks 2 and 4 operate during the next pattern-wheel rotation; or, for special patterning effects, the first series of jacks 1 and 3 operate during one half of a pattern-wheel rotation and the second series of jacks 2 and 4 during the other half of a pattern-wheel rotation; or the like. Which of these control schemes actually results, depends upon which groups of needles are provided with a-row and b-row pattern bolts and which are provided with c-row and d-row pattern bolts, in the case of the first embodiment, or which groups of needles have their cover plates (FIGS. 4*a* and 4*b*) or shiftable bolt carriers (FIG. 7) shifted, and the number of needles associated with each individual shiftable structure. In all these cases, however, the division of patterning information is always very orderly and easy to visualize, i.e., as between the first jack series 1, 3 and the second jack series 2, 4. However, viewed most broadly, the increased patterning capability of the inventive system results, in particular, from the fact that the pattern wheel 16 is provided with more than one jack per interneedle interval, two jacks per interneedle interval in the illustrated embodiments. As an abstract possibility, the division of pattern information among the various jacks 1–4 could be made highly "scrambled" by corresponding "scrambled" placement of pattern bolts. For example, in the illustrated embodiments, the jacks 1 and 3 control for a while (e.g., during one pattern-wheel rotation or the first half thereof) and then the jacks 2 and 4 control for a while (e.g., during the second half of the pattern-wheel rotation or during the second rotation). This is because, in FIG. 3, first a group of needles is provided with pattern bolts alternating between the a and b rows, with the next group of needles provided with pattern bolts alternating between the c and d rows, and so forth. However, the bolts in FIG. 3 could be differently set up: for example, the first needle with an a-row bolt, the next with a b-row bolt, the third with a c-row bolt, the fourth with a d-row bolt, the fifth with an a-row bolt again, and so forth. Although this possibility, and others which are even less visualizable and less orderly, would be somewhat confusing during jacquard-card perforation, such possibilities would still exhibit the inventive pattern-expansion capability, and be comprehended within the scope of the invention.

It will be understood that each of the elements described above, or two or more together, may also find a useful application in other types of constructions differing from the types described above.

While the invention has been illustrated and described as embodied in a very particular type of knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a knitting machine which includes an elongated needle bed and a series of knitting needles disposed in said bed for longitudinal shifting movement, a novel patterning arrangement, the patterning arrangement comprising, in combination, a bolt carrier structure extending along the length of the needle bed, the bolt carrier structure being provided with pattern-bolt guide bores accommodating pattern bolts guided within said bores for movement in a direction which is transverse to both the direction of elongation of the needles and the direction in which adjoining needles in the needle bed are spaced from each other, each pattern bolt having a guide passage through which the shank of a respective needle extends, the shank of each individual needle extending through the guide passage of one and only one of the pattern bolts, the pattern bolts of different needles being located at different heights, measured in the direction of needle elongation;

a cam carriage mounted for travel along the length of the needle bed, the cam carriage being provided with a rotating pattern wheel, the rotating pattern wheel accommodating a first circumferential succession of jacks each tiltable between operative and inoperative positions, each such jack when in the operative position being capable of engaging and moving pattern bolts which are located at first predetermined heights in order to cause the needles associated with those pattern bolts to be transversely displaced, the circumferential spacing between adjoining ones of the jacks in the first circumferential succession corresponding to the interneedle interval of said needle bed, the rotating pattern wheel furthermore accomodating a second circumferential succession of jacks, the jacks of the second circumferential succession being equal in number to those of the first, the jacks of the second succession likewise each being tiltable between operative and inoperative positions and when in the operative position each being capable of engaging and moving pattern bolts which are located at respective second predetermined heights in order to cause the needles associated with those pattern bolts to be transversely displaced, the circumferential spacing between adjoining ones of the jacks in the second circumferential succession corresponding to the interneedle interval of said needle bed, the jacks of the first and second successions each having a bolt-engaging portion, the bolt-engaging portions of corresponding jacks in the two successions being located one directly above the other, the jacks of the first and second successions each having an activating portion, the activating portions of corresponding jacks in the two successions being located spaced from each other in the direction circumferentially of the pattern wheel, the pattern wheel accordingly being provided with two jacks per interneedle interval, the cam carriage furthermore being provided with cam means upstream of the pattern wheel, the cam means being operative for causing those needles which have not been transversely displaced by their pattern bolts to perform predetermined knitting motions;

and jacquard patterning means operative for acting upon the activating portions of the jacks and causing different ones of the jacks of the first and second circumferential successions to assume operative and inoperative positions previous to the performance of an operating stroke by the cam carriage.

2. The patterning arrangement defined in claim 1, the jacquard patterning means comprising a set of jacquard selectors arranged in pairs to form a set of jacquard-selector pairs extending in the direction of cam-carriage travel, each jacquard selector being mounted for movement between a selecting position and a non-selecting position, each jacquard selector when in one of the positions thereof causing a pattern-wheel jack to assume one of said operative and inoperative positions, each jacquard selector when in the other of the positions thereof not causing a pattern-wheel jack to assume said one of said operative and inoperative positions, the jacquard patterning means furthermore including means holding a jacquard card, the jacquard card being provided with a series of information locations engageable by the jacquard selectors, the series of locations extending in the direction of cam-carriage travel, each information location being simultaneously engageable by both the jacquard selectors of a respective jacquard-selector pair of the set of jacquard-selector pairs.

3. The patterning arrangement defined in claim 1, the pattern-wheel jacks each being tiltable about a tilting point, each jack of the second circumferential succession of jacks having a transverse offset between the tilting point thereof and the bolt-engaging portion thereof.

4. The patterning arrangement defined in claim 1, the pattern wheel being provided with an arresting plate having an arresting position and a released position, the arresting plate when in the released position permitting the positions of the jacks to change, the arresting plate when in the arresting position locking the jacks in the positions selected by the jacquard patterning means, the arresting plate having plural steps serving when the arresting plate is in its arresting position to engage each of said jacks irrespective of whether each jack is in operative or inoperative position.

5. The patterning arrangement defined in claim 1, the bolt guide bores being arranged on the bolt carrier structure in a first, a second, a third and a fourth row of bolt guide bores, each row of bolt guide bores extending in the direction of cam-carriage travel, each needle in the needle bed being lined up with two respective bolt guide bores one of which is in one of the rows of bolt guide bores and the other of which is in another one of the rows of bolt guide bores, the needles of the needle bed consisting of odd-numbered needles alternating with even-numbered needles, the bolt guide bores of all the odd-numbered needles all being in two of the four rows of bolt guide bores, the bolt guide bores of all the even-numbered needles all being in the other two of the four rows of bolt guide bores, only one of the two bolt guide bores of each needle actually containing a pattern bolt, the jacks of the first circumferential succession of jacks consisting of first-row jacks having bolt-engaging portions located at the height of the first row of guide bores alternating circumferentially with second-row jacks having bolt-engaging portions located at the height of the second row of guide bores, the jacks of the second circumferential succession of jacks consisting of third-row jacks having bolt-engaging portions located at the height of the third row of guide bores alternating circumferentially with fourth-row jacks having bolt-engaging portions located at the height of the fourth row of guide bores.

6. The patterning arrangement defined in claim 1, the bolt guide bores being arranged on the bolt carrier structure in a first, a second, a third and a fourth row of bolt guide bores, each row of bolt guide bores extending in the direction of cam-carriage travel, each needle in the needle bed being lined up with two respective bolt guide bores one of which is in one of the rows of bolt guide bores and the other of which is in another one of the rows of bolt guide bores, the needles of the needle bed consisting of odd-numbered needles alternating with even-numbered needles, the bolt guide bores of all odd-numbered needles all being in two of the four rows of bolt guide bores, the bolt guide bores of all the even-numbered needles all being in the other two of the four rows of bolt guide bores, all the bolt guide bores in the four rows of bolt guide bores actually accommodating a pattern bolt, the bolt carrier structure furthermore including a series of cover plates, the series of cover plates extending in the direction of cam-carriage travel, each cover plate being shiftable between a first position and a second position, each cover plate being provided with a plurality of apertures, the apertures of each cover plate being so arranged that when the cover plate is in one of its two positions one and only one of the two bolt guide bores of each needle within the length of the cover plate is unblocked by an aperture, whereas when the cover plate is in the other of its two positions the other one and only the other one of the two bolt guide bores of each needle is unblocked by an aperture, the jacks of the first circumferential succession of jacks consisting of first-row jacks having bolt-engaging portions located at the height of the first row of guide bores alternating circumferentially with second-row jacks having bolt-engaging portions located at the height of the second row of guide bores, the jacks of the second circumferential succession of jacks consisting of third-row jacks having bolt-engaging portions located at the height of the third row of guide bores alternating circumferentially with fourth-row jacks having bolt-engaging portions located at the height of the fourth row of guide bores.

7. The patterning arrangement defined in claim 6, the bolt carrier structure having a fifth row of bolt guide bores extending in the direction of cam carriage travel and containing bolts coupled to predetermined ones of the needles, each cover plate being additionally provided with elongated apertures which are elongated in the direction of shifting movement of the cover plate, the length and location of the elongated apertures being such as to unblock the bolts of the fifth row of bolt guide bores irrespective of the position of the cover plate.

8. The patterning arrangement defined in claim 1, the jacks of the first circumferential succession of jacks consisting of jacks having bolt-engaging portions located at a first predetermined height alternating circumferentially around the pattern wheel with jacks having bolt-engaging portions located at a different second predetermined height, the jacks of the second circumferential succession of jacks consisting of jacks having bolt-engaging portions located at a third predetermined height different from said first and second predetermined heights alternating circumferentially around the pattern wheel with jacks having bolt-engaging portions located at a still further fourth predetermined height, the bolt carrier structure comprising a series of shiftable bolt carrier units, the series of bolt carrier units extending in the direction of cam-carriage travel, each shiftable bolt carrier unit being located alongside a respective group of needles of the needle bed, the shiftable bolt carrier units being provided with the pattern-bolt guide bores, each shiftable bolt carrier unit being mounted for shifting movement in the direction of elongation of the needles between a first position in which the bolt-engaging portions of the jacks of only the first succession can engage the pattern bolts of the shiftable bolt carrier unit, a second position in which the bolt-engaging portions of the jacks of only the second succession can engage the pattern bolts of the shiftable bolt carrier unit and a pattern-override position in which the bolt-engaging portions of the jacks of neither the first nor the second succession can engage the pattern bolts of the shiftable bolt carrier unit.

9. The patterning arrangement defined in claim 8, the length of each individual shiftable bolt carrier unit, measured in the direction of cam-carriage travel, having a value corresponding to at most the circumference of the pattern wheel.

10. The patterning arrangement defined in claim 2, each jacquard-selector pair consisting of a first and a second jacquard selector, each jacquard selector having a jack-engaging portion and a jacquard-card-engaging portion, the jack-engaging portions of the first and second selectors for each jacquard-selector pair being located spaced from each other in the direction of cam-carriage travel in correspondance to the spacing between the activating portions of corresponding jacks in the first and second successions, the jacquard-card-engaging portions of the selectors of each jacquard-selector pair being at equal distances from the jacquard card and being located side-by-side in a direction which is transverse both to the direction of cam-carriage travel and the direction of needle elongation.

* * * * *